US008857019B1

(12) United States Patent
Nykoluk

(10) Patent No.: US 8,857,019 B1
(45) Date of Patent: Oct. 14, 2014

(54) SERVICE BELT BUCKLE

(75) Inventor: Cory Nykoluk, Oakdale, CA (US)

(73) Assignee: 5.11 Inc., Modesto, CA (US)

( * ) Notice: Subject to any disclaimer, the term of this patent is extended or adjusted under 35 U.S.C. 154(b) by 135 days.

(21) Appl. No.: 13/371,148

(22) Filed: Feb. 10, 2012

(51) Int. Cl.
*A44B 11/25* (2006.01)
*A44B 11/26* (2006.01)

(52) U.S. Cl.
USPC ..... 24/587.12; 24/615; 24/625

(58) Field of Classification Search
USPC ..... 24/593.1, 191, 193, 614, 615, 629, 643, 24/644, 647, 587.12, 625
See application file for complete search history.

(56) References Cited

U.S. PATENT DOCUMENTS

| | | | | |
|---|---|---|---|---|
| 2,956,324 | A | 10/1960 | Klein | |
| 4,052,774 | A | 10/1977 | Noda | |
| 4,054,972 | A | 10/1977 | Rowell | |
| 4,282,634 | A | 8/1981 | Krauss | |
| 4,825,515 | A * | 5/1989 | Wolterstorff, Jr. | 24/625 |
| 4,928,364 | A * | 5/1990 | Ikeda | 24/614 |
| 5,224,247 | A | 7/1993 | Collier | |
| 5,440,792 | A | 8/1995 | Ida | |
| 5,628,095 | A | 5/1997 | Appel et al. | |
| 6,049,954 | A * | 4/2000 | Britto | 24/579.11 |
| 6,138,330 | A * | 10/2000 | Galbreath | 24/625 |
| 6,311,374 | B1 * | 11/2001 | Anscher | 24/625 |
| 7,480,967 | B2 | 1/2009 | Kojoori et al. | |
| 7,681,288 | B1 * | 3/2010 | Giampavolo | 24/615 |
| D671,442 | S * | 11/2012 | Paik et al. | D11/216 |
| 2004/0226150 | A1 * | 11/2004 | Beletsky | 24/625 |
| 2011/0271499 | A1 * | 11/2011 | Parisi | 24/615 |

* cited by examiner

*Primary Examiner* — Robert J Sandy
*Assistant Examiner* — Rowland Do
(74) *Attorney, Agent, or Firm* — Thomas M. Freiburger

(57) ABSTRACT

A belt buckle primarily for law enforcement or military personnel, for a relatively wide service belt, is of low profile, i.e. narrow from left to right so as to occupy minimal belt span to provide maximum space for equipment to be supported on the belt.

1 Claim, 3 Drawing Sheets

SERVICE BELT BUCKLE

BACKGROUND OF THE INVENTION

The invention generally concerns tactical gear, but specifically a belt buckle for police, military or tactical personnel, the belt buckle being of low profile (width) so as to minimize the length of belt span which it occupies.

Belt buckles have been provided in a variety of forms. Police and tactical personnel normally wear a heavy, somewhat wide belt on which may be carried one or more weapons, ammunition, communication gear or other equipment. The typical belt buckle is fairly heavy duty and can occupy a considerable amount of space in the circumference of the belt span, especially at front, limiting space for equipment carried on the belt. An objective of the current invention is to minimize the lateral width of belt span occupied by a belt buckle while providing a strong, heavy duty buckle that is also aesthetically attractive.

The prior art contains several buckles or clasps relevant to the present invention. These include U.S. Pat. Nos. 7,480,967, 2,956,324 and 4,054,972. The first of these shows a conventional belt buckle with a typical prong to engage through a selected hole in an end portion of a belt, but with a mechanism to remove the terminal, active part of the belt buckle from a separately formed base end, with a slide-apart motion. A male cylinder component slides into a female cylindrical slot, with a ball and detent provided to hold these components together. The buckle is not of low profile in the lateral direction, and the slide-apart feature is not used to engage and release the belt from the person's waist, but rather to remove the operative buckle component from the base part of the buckle.

U.S. Pat. No. 2,956,324 noted above describes a buckle with cylindrical slide-together parts configured on a slant, the assembly not being one of low profile. U.S. Pat. No. 4,054,972 shows a typical brassiere clamp that involves sliding the components together vertically in the typical manner.

U.S. Pat. Nos. 4,282,634 and 5,447,092 describe belt buckles with typical male/female components configured to plunge together in the axial (belt-tightening) direction of the belt, engaged by plastic spring tabs that snap into place.

SUMMARY OF THE INVENTION

The invention is a two-part belt buckle, preferably formed of molded plastic (such as injection-molded nylon or acetal) and of a low profile laterally (left to right as worn) so as to preserve space in the belt's span for tactical or other equipment to be retained on the belt. To this end the two parts of the buckle have male and female components that slip together and apart in a vertical motion relative to one another, which enables a buckle design of limited lateral width, occupying, for example, only about 1¾ inches of belt space, or even less, such as 1½ inches. The buckle has a slender and smoothly contoured exterior when clipped together, and tends to appear as a single body on the belt.

This is achieved with male and female buckle components, the male component having an elongated lug of preferably rectangular cross section that slides vertically into and latches in a complementary slot in a casing of the female component. Each component has an outer or outboard side, to which the belt is affixed, and to facilitate the sliding together of the lug and slot. The outboard part of the male component is connected by a thin bridging element to the lug, and the female component has a narrow slit opening the slot on the connecting side. Thus, the thin bridging element slides through the slit as the male lug slides into the slot.

The two components latch together via a spring latch of the male lug, a cantilevered plastic arm that is squeezed to a slightly retracted condition during insertion of the lug and then snaps back outwardly (forwardly, with respect to a person when worn) when the end of the spring latch reaches an open notch of the slot in the casing. This occurs when the lug is fully inserted into the slot, the two components being securely nested together. In a preferred form the spring latch's end is a rounded knob that becomes exposed at the front of the buckle when secured, so that the knob can be pushed in for release, allowing separation of the two components.

It is a main object of the invention to provide a narrow two component service belt buckle that leaves a maximum of belt span for carrying tactical weapons and other service equipment on the belt, especially at the front of the user. This is accomplished with two buckle components that slide together vertically and snap into a latched state, conveniently released by the wearer when desired. These and other objects, advantages and features of the invention will be apparent from the following description of a preferred embodiment, considered along with the accompanying drawings.

DESCRIPTION OF PREFERRED EMBODIMENTS

Figure 1:
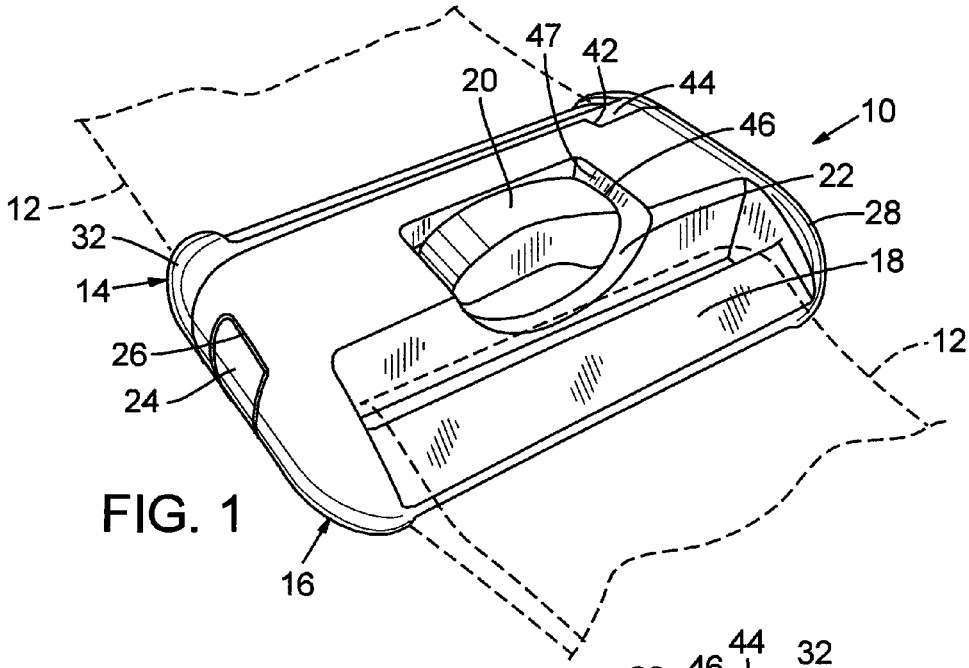
FIG. 1 is a perspective view showing a belt buckle of the invention in a secured configuration, and indicating attachment of the belt.

FIG. 1 shows a belt buckle 10 of the invention in a secured-together condition, and indicates two ends of a belt 12 connected to the two belt buckle components 14 and 16. Note that the belt is shown connected by looping over a bar 18 at outer or outboard sides of each of the two components 14 and 16 (only visible on the component 16 in FIG. 1). Other types of connections to the belt could be employed, and the bar 18 could be replaced with a double bar system for webbing tensioning. The figure shows a latch device 20, seen here as a somewhat rounded knob, that pops up into place in a notch 22 when the two components are fully inserted together.

Figure 2:
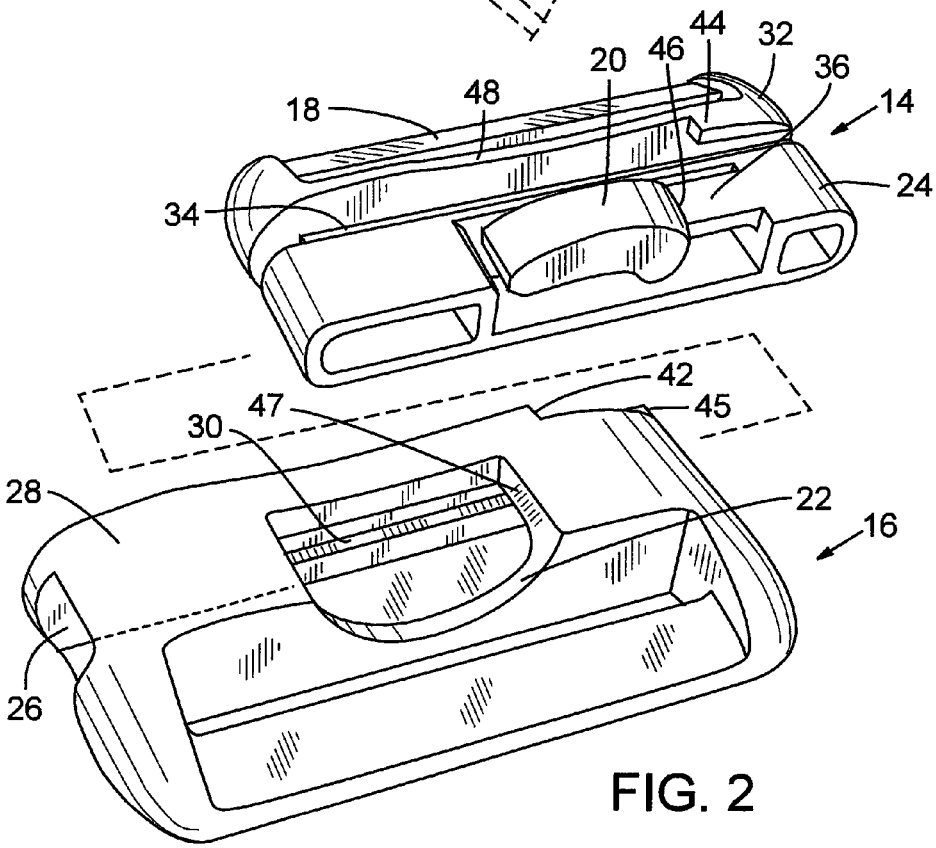
FIG. 2 is an exploded view showing the two components of the buckle in perspective.

FIG. 2 shows the two components 14 and 16 separated, in exploded view. The male component 14 has an elongated lug 24 that, as indicated, inserts into a slot 26 of the female component 16. The elongated lug 24 preferably is essentially rectangular-shaped in cross section as shown, with parallel sides and of a configuration to fit closely within the slot 26 of the female component 16. The slot 26 is formed within a casing 28, this casing having a narrow slit 30 at a connection side of the component 16, and this slit, although not so indicated in FIG. 2, extends to the right in the drawing completely to the end of the slot 26. The purpose of the slit 30 in the side of the slot is to enable the slug lug 24 to be inserted in the slot 26 without interference from the remainder of the male component 14, which includes an outer or outboard side 32 as seen in FIG. 2. The outboard side 32 of the male component is connected to the lug 24 by a narrow bridging element or plate 34, and this bridging element 34 slides through the slit 30 in the side of the slot 26 as the belt components are assembled together. The bridging plate 34 terminates as shown without reaching the end of the lug 24 (i.e. at the left in FIG. 2), so that the slit 30 need not extend completely to the end of the slot (at left in FIG. 2), leaving some solid structure for integrity of the female component.

The latch device 20, as seen in FIG. 2, is essentially a cantilevered leaf spring 36 formed integrally with the remainder of the preferably plastic female component 14. This cantilever has a free end at the left in the drawing, and this free end has a latch component that can comprise the generally rounded knob 20 seen in the drawings, although other shapes can be used. As can be seen from FIGS. 1 and 2, the rounded knob provides an incline that forces the cantilevered latch leaf spring 36 to an inwardly compressed position as the lug 24 is pushed into the slot 26, but when the latch component 20 reaches the opening or notch 22, the cantilever spring snaps the latch component 20 outwardly, up into the notch, locking the male component at the fully inserted position in the female component. For release, a wearer simply pushes the exposed rounded knob or latch component 20 inward (toward the user's body), allowing the male component to be slid out and removed from the female component.

Figure 3:
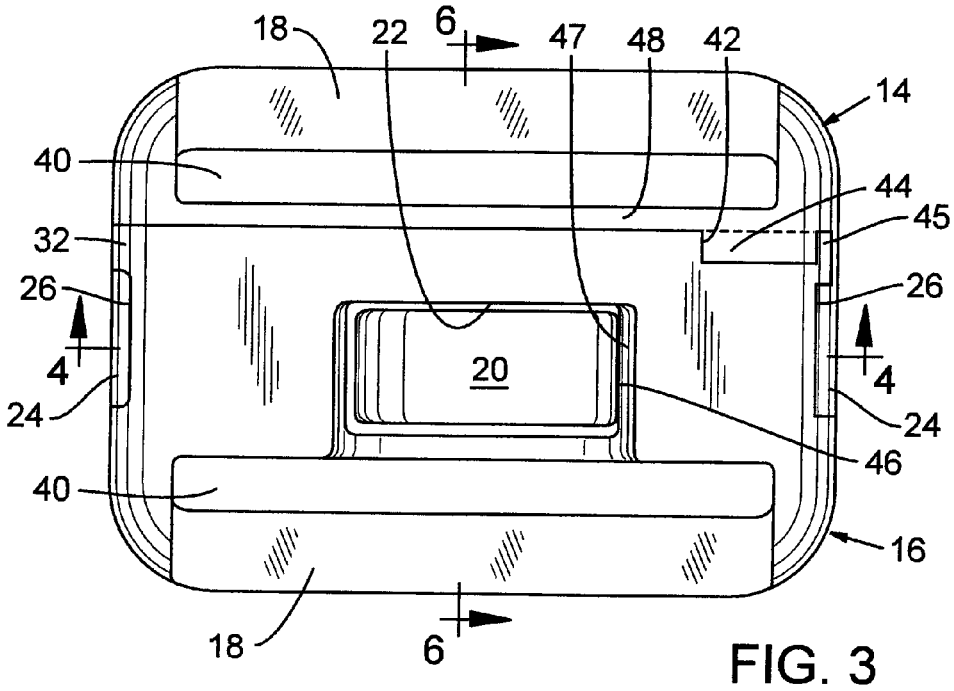
FIG. 3 is a top plan view showing the belt buckle as secured together.

FIG. 3 shows the secured belt buckle in plan view. The drawing shows elongated openings 40, one on each component, for receiving the belt, which loops over the bar 18 on each component. The male component 14 is shown at the upper side of FIG. 3, as it is in FIGS. 1 and 2. As seen in all of FIGS. 1, 2 and 3, the female component's casing 28 has a form of step 42 at its outer surface, and the outboard side 32 of the male component has a similar, complementary-shaped flange or edge 44. The flange 44 abuts the step 42 when the male component is fully connected into the female component, as can best be seen in FIGS. 2 and 3. This defines the fully connected position and serves to prevent further sliding of the lug 24 through the slot 26, even with force. Note that this function could also be accomplished by other structural limiting features, if desired.

A part 45 at one end of the female component 16 is seen in FIG. 3. This slides under the adjacent structure of the male component's outboard side 32 as the male component 14 is slid to the right in FIG. 3, or the female component 16 to the left in FIG. 3. It slides under the element 44, which can be understood with reference to FIG. 2 as well as FIG. 3.

Figure 4:
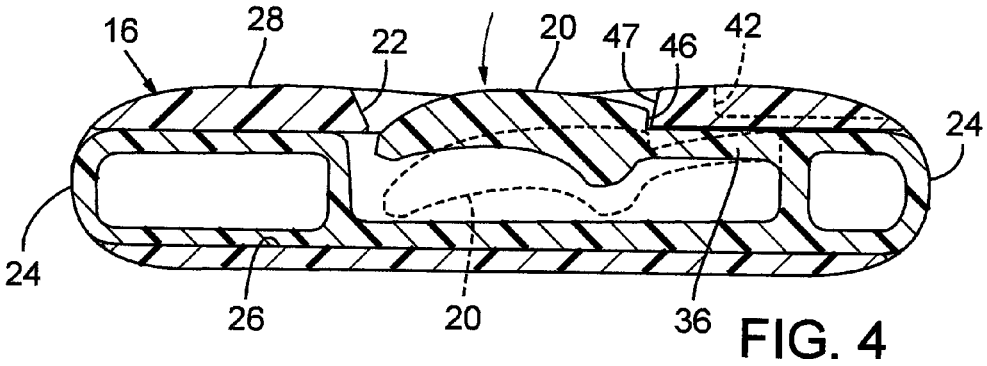
FIG. 4 is a sectional view as seen along the line 4-4 in FIG. 3, showing the secured buckle.
Figure 5:
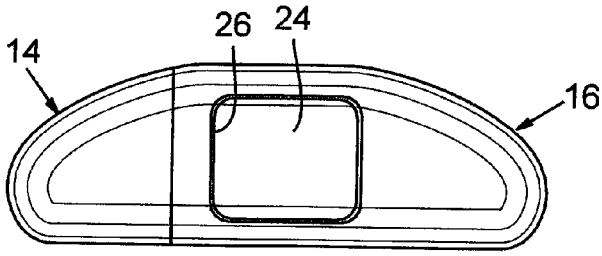
FIG. 5 is an end view of the connected-together buckle, seen from what could be the bottom or the top of the buckle, essentially from the left in FIG. 1.

FIG. 4 shows the two components in cross section, in the fully secured position, and indicates the action of depressing the rounded knob latch component 20 inwardly for release (the depressed, released position of the latch is shown in dotted lines). As illustrated, the rounded knob or latch component has a ledge abutment 46 at its back edge closer to the point of cantilever support, and this snaps out into position (solid lines in FIG. 4) when the fully inserted position is reached, held in place by engaging with a face 47 of the female component.

Preferably each of the components 14 and 16 is injection molded of a strong plastic material, with the cantilever spring element or latch component integrally molded in the male component.

Figure 6:
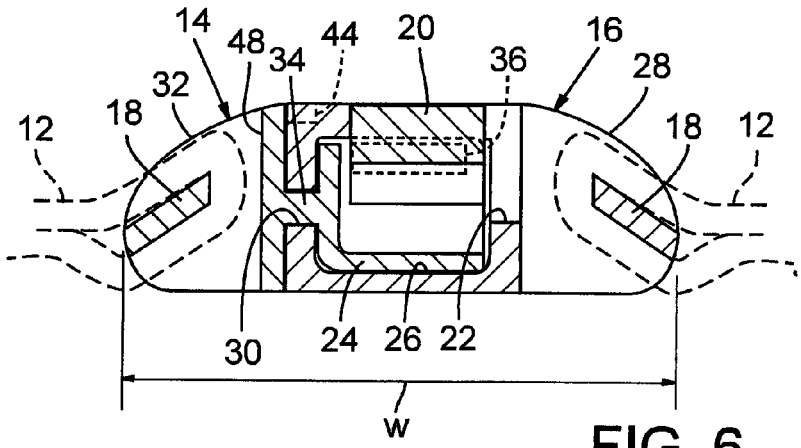
FIG. 6 is a sectional view of the secured belt buckle, as seen along the line 6-6 in FIG. 3.
Figure 7:
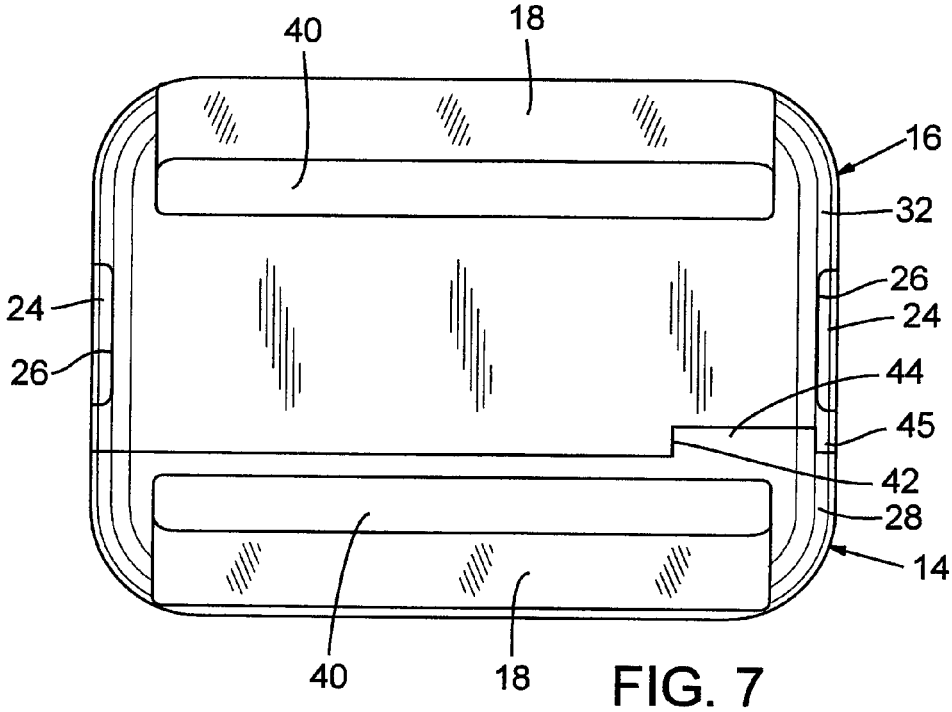
FIG. 7 is a bottom or back side plan view of the secured buckle.

The sectional view of FIG. 6 again shows the belt 12 secured to the outer or outboard sides of the male and female components, each belt end looping over a connecting bar 18 of the respective component. As noted above, other belt securement arrangements are possible. The lug 24 is shown within the slot 26, the lug being without walls at upper and right sides in this central region, which can be seen from FIG. 2. The thin bridging element 34 is seen extending through the slit 30, and a wall 48 at the outboard side 32 of the male component is seen integrally connected to the bridging element 34. The secured buckle can withstand very high belt tension, due to the engagement of the entire length of the lug 24 against the entire length of the outer wall of the female component 16, at both sides of the slit 30 (above and below the slit as seen in FIG. 6). Moreover, the slit 30 is open at its end which is shown to the right as the component is viewed in FIGS. 2 and 3, and could tend to spread open and fail under very high belt tension. Spreading is prevented by the flanges 44 of the male component, the flanges 44 being on both front and back and retaining the structure at the slit from spreading open. See also FIGS. 6 and 7. The width of the assembled belt buckle (dimension from left to right as worn) is indicated, and as noted above, this is preferably no more than about 1¾ inches or preferably in the range of about 1½ to 2 inches. A typical belt that connects together horizontally with a similar latch oriented horizontally would be about 2% to 3 inches wide. The height of the buckle can vary according to the belt, but may be about 2½ inches, or about 1½ to 3 inches. The buckle is intended for a belt of at least about 1¾ inch width, preferably at least about two inches width.

As seen in the drawings, the assembled belt buckle is smoothly contoured, with rounded sides and edges and with the two components closely mated. As such, the secured buckle gives the appearance of a slim, smoothly contoured and unitary device when worn.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A belt buckle of narrow profile for police or other persons wearing a service belt to carry equipment, comprising:

a male buckle component and a female buckle component, each having a belt securement means at an outer side of the component for securement of a belt end with a belt width of a preselected size, the female component including a casing at an inboard side of the female component in position to receive the male component, the casing including an elongated internal slot in vertical orientation, said vertical orientation being perpendicular to the length of a belt which would be secured by said belt securement means, the internal slot being open at one end of the slot to receive the male component, and the casing having a narrow elongated slit parallel to the elongated internal slot, the slot being open to an exterior of the female component through the slit, the male component including an elongated connecting lug at an inboard side of the male component in vertical orientation in position to engage with the casing of the female component, the lug having an exterior shaped to fit closely in the internal slot of the casing of the female component so as to be slidable vertically into said one open end of the internal slot until the lug is contained in the internal slot of the casing, the male component including a thin bridging plate connecting said outer side of the male component to the lug, the thin bridging plate fitting closely into said elongated slit in the casing of the female component to permit the lug to slide into the elongated slot of the casing without interference from the outer side of the male component, and such that when the male and female components are engaged together the outer side of the male component is nested closely against the inboard side of the female component, and the lug having an integrally formed spring latch comprising a leaf spring arm extending angularly outwardly from the lug, and having a cantilevered free end with a latch component, and the casing of the female component having an open notch positioned to be engaged by the latch component when the lug is fully inserted into the casing slot so as to latch and retain the lug in the casing, the latch component comprising a knob positioned to snap outwardly away from the wearer and into the open notch when the male component is fully inserted, such that the knob can be depressed by a user against the force of the leaf spring arm to push the knob out of the notch and release the buckle by sliding the male component out of the slot, whereby the buckle secured together and in use will occupy a minimal amount of belt laterally.

* * * * *